US005296020A

United States Patent [19]

Reichert et al.

[11] Patent Number: 5,296,020

[45] Date of Patent: Mar. 22, 1994

[54] FORMULATION FOR THE ACTIVATION OF SUBSTRATE SURFACES FOR CURRENTLESS METALLIZATION THEREOF

[75] Inventors: Günther Reichert, Cologne; Frank Kobelka, Leverkusen; Gerhard-Dieter Wolf, Dormagen; Ulrich von Gizycki, Leverkusen, all of Fed. Rep. of Germany

[73] Assignee: Bayer Aktiengesellschaft, Leverkusen, Fed. Rep. of Germany

[21] Appl. No.: 864,782

[22] Filed: Apr. 7, 1992

[30] Foreign Application Priority Data

Apr. 11, 1991 [DE] Fed. Rep. of Germany ..... 4111817

[51] Int. Cl.[5] ..... C23C 18/30

[52] U.S. Cl. ..... 106/1.11; 427/443.1; 106/128

[58] Field of Search ..... 106/1.11-1.29; 427/443.1

[56] References Cited

U.S. PATENT DOCUMENTS 3,930,109 12/1975 Brandt et al. ..... 428/422

*Primary Examiner*—Helene Klemanski
*Assistant Examiner*—Margaret Einsmann
*Attorney, Agent, or Firm*—Sprung, Horn, Kramer & Woods

[57] ABSTRACT

Formulations containing an organometallic activator, a filler, a solvent and an aqueous dispersion of a polyurethane polymer are outstandingly suitable for activation of surfaces of plastics for currentless metallisation thereof.

The components of plastic activated in this way are preferably employed, after metallisation has been carried out, for shielding from electromagnetic waves.

8 Claims, No Drawings

FORMULATION FOR THE ACTIVATION OF SUBSTRATE SURFACES FOR CURRENTLESS METALLIZATION THEREOF

BACKGROUND OF THE INVENTION

It is generally known that polymeric materials have to be pretreated, for example by etching of the polymer surface with chromic/sulphuric acids, before chemical metallisation. However, this process can be applied only to those polymers, the surface of which can be modified oxidatively with the formation of caverns and vacuoles.

It is furthermore known that working with chromic/-sulphuric acid, $SO_3$ vapour or other oxidising agents is accompanied by a deterioration in the physical properties, such as the notched impact strength and the electrical surface resistance, of the polymeric material. Moreover, traces of hexavalent chromium, which rapidly lead to poisoning of the metal baths, often cause interference.

The known processes for the currentless metallisation of materials moreover comprise several process stages and have the disadvantage that they cannot be applied directly to all polymers. Chemical or physical roughening often has to be carried out.

It has therefore already been proposed to activate the polymer surfaces very gently using organometallic catalysts (compare, for example, U.S. Pat. No. 3,560,257 and EP-A 81,129). Nevertheless, this method, which is very elegant per se, is likewise not universally applicable. The use of solvents furthermore often leads to stress corrosion cracking being caused in the polymer injection moulding which is under tensile or compressive stress.

Other processes, such as are described in U.S. Pat Nos. 3,560,257 and 4,017,265 as well as DE-A 3,627,256, have the disadvantage that they require relatively larger quantities of expensive noble metal activators.

SUMMARY OF THE INVENTION

It has now been found, surprisingly, that firmly adhering metal layers can be produced on surfaces of plastics without the disadvantages mentioned if these surfaces are treated, without prior etching, with an activator formulation based on organic noble metal compounds, fillers, a solvent and an aqueous dispersion of a polyurethane polymer as a binder. The formulations are characterised in that they contain an aqueous dispersion of a polyurethane polymer.

DETAILED DESCRIPTION OF THE INVENTION

Preferred formulations contain:

a) 0.03 to 3.0 parts by weight of an organic noble metal compound as an activator,
b) 10 to 30 parts by weight of a solvent having a flash point of >20° C. and a boiling point of ≦70° C.,
c) 0.5 to 3.0 parts by weight of a filler, and
d) 12 to 28 parts by weight of a polyurethane polymer as an aqueous dispersion.

It is surprising that the formulations according to the invention effect a firmly adhering metallisation. Preferred spray activator formulations contain 0.05 to 1.5 parts by weight of component a) and 10 to 20 parts by weight of component b).

Possible activators in the formulations according to the invention are organometallic compounds of subgroups 1 and 8 of the periodic system (in particular Pd, Pt, Au and Ag), such as are described, for example, in EP-A 34,485, 81,438 and 131,198. Organometallic complex compounds of palladium with olefins (dienes), with $\alpha,\beta$-unsaturated carbonyl compounds, with crown ethers and with nitriles are particularly suitable. Bisacetonitrile-palladium dichloride, butadiene-palladium dichloride, 4-cyclohexane-1,2-dicarboxylic acid anhydride-palladium dichloride, mesityl oxide-palladium dichloride, 3-hepten-2-one-palladium chloride and 5-methyl-3-hexan-2-one-palladium chloride are especially suitable.

If desired, mixtures of these compounds can also be employed.

In the process according to the invention, the activators or the mixtures thereof are introduced into the aqueous dispersion. This is in general carried out by mixing the constituents. The components of the formulation can also be incorporated in separate steps. For example, the activator can first be predissolved or dispersed in a solvent of the total formulation, for example in ethanol, and the filler, for example Aerosil®, can then be added.

The activator is then reduced to the metallic form by addition of formalin or complexed by means of complexing agents and introduced into the aqueous dispersion of the binder. This is carried out by stirring or dispersing. Complexing agents which are employed are, for example, chlorides, thiosulphates, thiocyanates, cyanides, ammonia or amines. Examples of complex compounds are $Pd(NH_3)_2Cl_2$, $Pd(NH_3)_4Cl_2$, $Pd(NH_3)_4(NO_3)_2$, $K_2PdCl_4$, $K_2Pd(CN)_4$, $[NH_4]_2PdCl_6$, $[NH_4]_2PdCl_4$, $Pt(NH_3)_4Cl_2$, $K_2PtCl_4$, $KAg(CN)_2$, $KAg(S_2O_3)$, $KAu(CN)_2$ and $NaAuCl_4$.

The result achieved thereby is that on addition of the complexed activators to the aqueous dispersion, coagulation is avoided or reduced.

The presence of the activator in the complexed and also in the reduced metallic form leads to particularly good results in respect of smooth surfaces without defects during coating with the formulations according to the invention.

Zero-valent complex compounds, such as palladium(0)-tetrakis(triphenylphosphine), bis[bis-(1,2-diphenylphosphino)-ethane]-palladium(0) or bis(dibenzylidene-acetone)-palladium(0), are also possible.

Colloidal noble metal systems, which can likewise serve as activators, which may be mentioned are Pd, Ag, Au or Pt on active charcoal, on aluminium oxide, on calcium carbonate, on barium carbonate or on activated aluminium oxide, and palladium black or platinum black.

Possible fillers are auxiliaries known from printing and surface-coating, such as pigments, disperse silicic acids, carbon blacks, silicates, oxides, rheological additives and clay minerals.

The oxides of the elements Mn, Ti, Mg, Al, Bi, Cu, Ni, Sn, Zn and Si and mixed oxides thereof may be referred to in particular.

Silicates, bentonites, talc and chalk are preferably employed.

The amount of filler can vary in the range from 0.5 to 3 parts by weight, based on the weight of the formulation.

In addition to the dispersible polymers, activators and fillers, it is also possible for other constituents, such as surfactants, flow-control agents, foam suppressants, dyestuffs and metal dyestuffs, to be admixed in small concentrations of up to 10% by weight, preferably up to 2% by weight.

Possible solvents in the formulations according to the invention are substances known in printing and surface-coating, such as ketones, for example methyl ethyl ketone or cyclohexanone, esters, for example butyl acetate, dioctyl phthalate or butyl glycolate, and glycol ethers, for example ethylene glycol monomethyl ether, diglyme or propylene glycol monomethyl ether-acetate; alcohols, such as ethanol, n-propanol, isopropanol, n-butanol or isobutanol; or diacetone alcohol. Mixtures of these solvents and their blends with other solvents can of course also be employed.

The solvents employed serve merely to dissolve the organic Pd compound, and if appropriate can be removed by evaporation after the reduction of the noble metal activator has been carried out.

Only small amounts of solvent therefore have to be employed. The particle size of the metallic noble metal produced during reduction can furthermore be influenced by the use of solvents.

The binders according to the invention in the aqueous dispersion with a polymer content of 10–60, preferably 20–55, especially preferably 30–50% b.w. are known from polyurethane chemistry. They are prepared, for example, by reaction of polyesters and/or polyethers with aromatic or aliphatic polyisocyanates (Angew. Chemie 82 (1970), 53–65; DE-OS 23 14 512; DE-OS 23 14 513; DE-OS 26 51 506).

To prepare a storage-stable, toxicologically acceptable formulation which can be sprayed, it is advantageous to employ polyurethanes which contain no free isocyanate groups, optionally masked isocyanate groups and/or anionic groups, for example $SO_3$ groups.

Linear, aliphatic polyurethanes, such as are prepared, for example, from hexanediol, neopentylglycol and polyisocyanates, have proved to be particularly suitable.

In addition to the activators and salts, fillers, binders and solvents, the formulations contain, if appropriate, surfactants, flow-control agents and/or dyestuffs.

Surfaces can preferably be activated, for the purpose of a firmly adhering chemical metallisation, by spraying on the formulations according to the invention by means of processes known from the surface-coating industry. Spraying on of the formulations can of course be replaced by dipping, brushing on and rolling on.

Suitable substrates for the process according to the invention are paper, enamels, ceramic, polyethylene, polypropylene, epoxy resins, polyesters, polycarbonates, polyamides, polyimides, polyhydantoins, ABS plastics, silicones, polyvinyl halides and polyvinylidene fluoride, in the form of films, sheets, papers and non-wovens. Substrates such as are employed as housings in the electronics industry, for example ABS and polycarbonate plastics or blends thereof, polyphenylene sulphide, polybutylene terephthalate and blends thereof and polypropylene oxide, are particularly preferred.

After application of the formulations according to the invention to the surface, for example the inside of a housing, the solvents are removed. This is carried out by drying or heat treatment at substrate-specific temperatures, for example between room temperature and 240° C., under normal pressure or increased pressure or in vacuo. The drying time can be varied here.

The surfaces treated in this way must then be activated by reduction, for example by reducing agents such as formaldehyde, hypophosphites, Rongalit and boranes, only in the case of the complexed activator.

It should be mentioned expressly that in the case of the formulations according to the invention in which the activator is already present in completely reduced form, the surfaces require no further treatment step. The occurrence of stresses and disturbances during deposition of the metal is furthermore absent.

One form of the process therefore comprises carrying out the reduction, for example in the case of the complexed activators, in the metallisation bath directly with the reducing agent of the currentless metallisation. This applies to suitable nickel and copper baths.

A preferred embodiment of the process comprises employing formulations in which the activator is already present in active form by reduction.

The surfaces treated with the formulations according to the invention can be metallised under currentless conditions directly. The metallisation baths suitable for this are known in the art of currentless metallisation.

The formulations according to the invention are particularly suitable for the partial activation of geometrically complicated surfaces, in particular for the production of shaped articles metallised on one or both sides or of housing components, metallised on the inside, for the electronics industry for the purpose of electromagnetic shielding. Structured metal areas can of course also be produced by this process by means of a suitable mask.

The products identified with the letter "®" in the following examples are registered trademarks.

EXAMPLE 1

The 40% strength aqueous dispersion of a linear, slightly branched and emulsifier-free polyurethane employed was one based on linear polyesters and aliphatic polyisocyanates containing $SO_3$ groups. The average particle size was 100–300 μm. The density (DIN 51 757) at 20° C. was about 1.0 g/cm$^3$.

The recipe of a spray activator formulation consisted of the following components:

| | |
|---|---|
| 1 | part by weight of bis-(benzonitrile)-palladium(II) dichloride |
| 500 | parts by weight of a 40% strength aqueous dispersion of the polyurethane |
| 300 | parts by weight of water |
| 15 | parts by weight of Aerosil ® 380 (380 m$^2$/g according to the BET method) |
| 1.4 | parts by weight of 37% strength fresh aqueous formalin |
| 200 | parts by weight of ethanol |

The formulation can be prepared, for example, in that the Pd compound is dissolved in 200 ml of ethanol, the solution is then diluted with 200 ml of $H_2O$ and 15 g of Aerosil ® 380 (380 m$^2$/g according to the BET method) are stirred or dispersed in the preliminary solution. 1.4 ml of fresh aqueous formalin are then added by means of a syringe, while stirring.

After a stirring time of 2 hours, the suspension is mixed with the 40% strength aqueous dispersion of the polyurethane, while stirring. Finally, the mixture is subsequently diluted with 100 ml of water.

The spray activator formulation thus prepared was sprayed by means of a spray gun with air assistance (4 bar) onto injection-moulded test sheets (mouldings). The spray distance was about 40 cm; the nozzle cross-section was 1.5 mm; the metering in of air (2–6 bar) could be varied. A blend of ABS polymer (acrylonitrile-butadiene-styrene copolymer) and a polycarbonate of 4,4'-dihydroxydiphenyl-2,2-propane and carbonic acid was employed as the test sheet substrate.

After drying off, the sheet was heat-treated at 70° C. for 1 hour, metallised in a metal bath at 23° C. for 4 hours in a commercially available formalin-containing copper bath and then heat-treated at 70° C. for 1 hour. A coherent layer of metal was obtained.

Adhesive strength according to DIN 53494: 30 N/25 mm;

If sheets of polyamide or of a polyurethane are employed instead of the test sheet of the blend described above, comparable results are obtained.

EXAMPLE 2

The spray activator formulation was prepared and the process was carried out as in Example 1, except that 2 parts by weight of bis-(benzonitrile)-palladium(II) dichloride were employed in the spray activator formulation.

The recipe of the spray activator formulation consisted of the following components:

| | |
|---|---|
| 2 | parts by weight of bis-(benzonitrile)-palladium(II) dichloride |
| 500 | parts by weight of a 40% strength aqueous dispersion of the polyurethane as in Example 1 |
| 300 | parts by weight of water |
| 15 | parts by weight of Aerosil ® 380 (380 $m^2/g$ according to the BET method) |
| 1.4 | parts by weight of 37% strength fresh aqueous formalin |
| 200 | parts by weight of ethanol. |

The formulation was sprayed by means of a spray gun with air assistance onto an injection-moulded test sheet of a polycarbonate of 4,4'-dihydroxydiphenyl-2,2-propane and carbonic acid, and the plate was heat-treated at 100° C. for 1 hour and, after cooling, metallised in a metal bath at 23° C. for 2 hours. It was then heat-treated at 100° C. for 1 hour. A coherent layer of metal was obtained.

Adhesive strength according to DIN 53494: 18 N/25 mm.

EXAMPLE 3

The spray activator formulation was prepared and the process was carried out as in Example 1, except that 0.7 ml of formalin was employed.

The recipe of the spray activator formulation consisted of the following components:

| | |
|---|---|
| 1 | part by weight of bis-(benzonitrile)-palladium(II) dichloride |
| 500 | parts by weight of a 40% strength aqueous dispersion of the polyurethane as in Example 1 |
| 300 | parts by weight of water |
| 15 | parts by weight of Aerosil ® 380 (380 $m^2/g$ according to the BET method) |
| 0.7 | part by weight of 37% strength fresh aqueous formalin |
| 200 | parts by weight of ethanol. |

The formulation was sprayed by means of an air gun with air assistance onto an injection-moulded test sheet (moulding) of an ABS polymer (acrylonitrile-butadienestyrene copolymer), during which the metering in of air was adjusted to 4 bar. The sheet was heat-treated at 70° C. for 1 hour and, after cooling to room temperature, was metallised in a metal bath at 23° C. for 4.5 hours. A coherent layer of metal was obtained.

Adhesive strength in accordance with DIN 53494: 29 N/25 mm.

EXAMPLE 4

The same 40% strength aqueous dispersion of a polyurethane as in Example 1 was employed.

The recipe of the spray activator formulation consisted of the following components:

| | |
|---|---|
| 1 | part by weight of bis-(benzonitrile)-palladium(II) dichloride |
| 500 | parts by weight of the 40% strength aqueous dispersion of the polyurethane |
| 500 | parts by weight of water |
| 15 | parts by weight of Aerosil ® 380 (380 $m^2/g$ according to the BET method) |
| 1.4 | parts by weight of 37% strength fresh aqueous formalin |
| 200 | parts by weight of ethanol. |

The formulation was prepared by predissolving the palladium compound in 200 ml of ethanol. The solution was then diluted with 200 ml of water, and 15 g of Aerosil® 380 (380 $m^2/g$ according to the BET method) were stirred or dispersed into this preliminary solution. 1.4 ml of fresh aqueous formalin were then added by means of a syringe, while stirring.

After a stirring time of two hours, the suspension was diluted with 300 ml of water and was then heated at about 80° C.–100° C., while stirring further, until the ethanol had been removed without residue. Losses of evaporated water were compensated by topping up.

After the suspension had cooled to room temperature, it was mixed with the 40% strength aqueous dispersion of the polyurethane, while stirring.

The spray activator formulation thus prepared was sprayed by means of a spray gun with air assistance (4 bar) onto injection-moulded test sheets (mouldings). The spray distance was about 40 cm; the nozzle cross-section was 1.5 mm; the metering in of air (2–6 bar) could be varied.

A blend of ABS polymer (acrylonitrile-butadiene-styrene copolymer) and a polycarbonate of 4,4'-dihydroxydiphenyl-2,2-propane and carbonic acid was employed as the test sheet substrate.

After drying off, the sheet was dried at room temperature for 24 hours, metallised in a metal bath at 23° C. for 3 hours in a commercially available formalin-containing copper bath and then heat-treated at 70° C. for 1 hour. A coherent layer of metal was obtained.

Adhesive strength in accordance with DIN 53494: 25 N/25 mm.

EXAMPLE 5

The same 40% strength aqueous dispersion of a polyurethane as in Example 1 was employed.

However, the recipe of the spray activator formulation consisted of the following components:

| | |
|---|---|
| 1 | part by weight of bis-(benzonitrile)-palladium(II) dichloride |
| 500 | parts by weight of the 40% strength aqueous dispersion of the polyurethane as in Example 1 |
| 500 | parts by weight of water |
| 15 | parts by weight of Aerosil ® 380 (380 $m^2/g$ according to the BET method) |
| 1.4 | parts by weight of 37% strength fresh aqueous formalin |
| 200 | parts by weight of ethanol. |

The formulation is prepared as in Example 4.

The formulation was sprayed by means of a spray gun with air assistance onto an injection-moulded test sheet of polycarbonate from 4,4'-dihydroxydiphenyl-2,2-propane and carbonic acid and, after drying off, the sheet was dried at room temperature for 24 hours, metallised in a metal bath at 23° C. for 1.5 hours in a commercially available formalin-containing copper bath and then heat treated at 100° C. for 1 hour. A coherent layer of metal was obtained.

Adhesive strength according to DIN 53494: 20 N/25 mm.

EXAMPLE 6

The same 40% strength aqueous dispersion of a polyurethane as in Example 1 was employed.

However, the recipe of the spray activator formulation consisted of the following components:

| | |
|---|---|
| 1 | part by weight of bis-(benzonitrile)-palladium(II) dichloride |
| 500 | parts by weight of a 40% strength aqueous dispersion of the polyurethane as in Example 1 |
| 300 | parts by weight of water |
| 15 | parts by weight of Aerosil ® 380 (380 $m^2/g$ according to the BET method) |
| 0.7 | part by weight of 37% strength aqueous fresh formalin |
| 200 | parts by weight of ethanol. |

The formulation was prepared in that the palladium compound was predissolved in 200 ml of ethanol, the solution was then diluted with 200 ml of water, and 15 g of Aerosil ® 380 (380 $m^2/g$ according to the BET method) were stirred or dispersed into this preliminary solution. 0.7 ml of fresh aqueous formalin was then added by means of a metering device (syringe), while stirring.

After a stirring time of 2 hours, the suspension was diluted with 300 ml of water and then heated at about 80° C.–100° C., while stirring further, until the ethanol had been removed without residue. Losses of evaporated water were compensated by topping up with water.

After the suspension had cooled to room temperature, it was mixed with the 40% strength aqueous dispersion of the polyurethane, while stirring.

The spray activator formulation thus prepared was sprayed by means of a spray gun with air assistance (4 bar) onto injection-moulded test sheets (mouldings). The spray distance was about 40 cm; the nozzle cross-section was 1.5 mm; the metering in of air (2–6 bar) could be varied.

An ABS polymer was employed as the test sheet substrate.

After drying off, the sheet was dried at room temperature for 24 hours, metallised at 23° C. for 3 hours in a commercially available formalin-containing copper bath and then heat treated at 70° C. for 1 hour. A coherent layer of metal was obtained.

Adhesive strength in accordance with DIN 53494: 28 N/25 mm.

What is claimed is:

1. An activator formulation, for the activation of substrate surfaces for currentless metallisation thereof, consisting of a) 0.03 to 3.0 parts by weight of an organic noble metal, b) 0.5 to 3.0 parts by weight of fillers, c) 10 to 30 parts by weight of an organic solvent and d) 12 to 28 parts by weight of an aqueous dispersion of a polyurethane polymer.

2. The activator formulation of claim 1, containing 0.05 to 1.5 parts by weight of component a) and 10 to 20 parts by weight of component c).

3. The activator formulation of claim 1, wherein said organic noble metal compound is an organometallic compound.

4. The activator formulation of claim 3, wherein said organometallic compound is palladium in the form of an organometallic compound.

5. The activator formulation of claim 1, wherein said organic solvent is an alcohol, ketone, ether-ester or ketone alcohol.

6. The activator formulation of claim 5, wherein the solvent is ethanol, propanol or methyl ethyl ketone.

7. The activator formulation of claim 1, wherein the polyurethane polymer is built up from a polyester or polyether having terminal OH groups and a polyisocyanate.

8. A process for the activation of substrate surfaces for currentless metallisation thereof, wherein these are treated with a formulation according to claim 1.

* * * * *

UNITED STATES PATENT AND TRADEMARK OFFICE

CERTIFICATE OF CORRECTION

PATENT NO. : 5,296,020

DATED : March 22, 1994

INVENTOR(S) : Gunther REICHERT, et al.

It is certified that error appears in the above-identified patent and that said Letters Patent is hereby corrected as shown below:

Column 8, line 17 after "of" (second occurrence) cancel "an organic".

Column 8, line 18, after "metal" insert --compound--.

Signed and Sealed this

Twenty-ninth Day of June, 1999

*Attest:*

Q. TODD DICKINSON

*Attesting Officer*

*Acting Commissioner of Patents and Trademarks*